US006666671B1

(12) United States Patent
Olver et al.

(10) Patent No.: US 6,666,671 B1
(45) Date of Patent: Dec. 23, 2003

(54) ROTARY PUMP

(75) Inventors: Andrew Vernon Olver, Reading (GB); Giulio Francesco Contaldi, London (GB)

(73) Assignee: IC Innovations, London (GB)

( * ) Notice: Subject to any disclaimer, the term of this patent is extended or adjusted under 35 U.S.C. 154(b) by 0 days.

(21) Appl. No.: 10/009,173

(22) PCT Filed: Jun. 2, 2000

(86) PCT No.: PCT/GB00/02150

§ 371 (c)(1),
(2), (4) Date: Jan. 31, 2002

(87) PCT Pub. No.: WO00/75517

PCT Pub. Date: Dec. 14, 2000

(30) Foreign Application Priority Data

Jun. 9, 1999 (GB) ..... 9913438

(51) Int. Cl.[7] ..... F03C 2/00

(52) U.S. Cl. ..... 418/173; 418/138; 418/178; 418/179

(58) Field of Search ..... 418/173, 178, 418/179, 138

(56) References Cited

U.S. PATENT DOCUMENTS

| | | | | |
|---|---|---|---|---|
| 2,029,554 A | | 2/1936 | Berggren | |
| 2,714,372 A | * | 8/1955 | Williams | 418/173 |
| 3,647,328 A | * | 3/1972 | Fox | 418/136 |
| 4,648,819 A | | 3/1987 | Sakamaki | |
| 4,699,839 A | * | 10/1987 | Hornberger | 428/312.8 |

FOREIGN PATENT DOCUMENTS

| | | | | |
|---|---|---|---|---|
| DE | 3344883 A | * | 6/1984 | F04C/18/34 |
| DE | 39 36 429 A | | 5/1991 | |
| DE | 43 31 964 A | | 4/1994 | |
| GB | 363 471 A | | 1/1932 | |
| GB | 501693 | | 3/1939 | |
| GB | 646407 | | 11/1950 | |
| GB | 728269 | | 4/1955 | |
| GB | 809220 | | 2/1959 | |
| GB | 2 140 088 A | | 11/1984 | |
| GB | 2 140 089 A | | 11/1984 | |
| GB | 2 322 913 A | | 9/1998 | |
| JP | 11042503 A | * | 2/1999 | B23B/27/14 |
| WO | WO 97 21033 A | | 6/1997 | |

OTHER PUBLICATIONS

Patent Abstract of Japan; vol. 1996, No. 11; Nov. 29, 996 & JP 08 177772 A; Jul. 12, 1996.

Patent Abstract of Japan; vol. 9, No. 51; Mar. 6, 1985; & JP 59 188092 A; Oct. 25, 1984.

Patent Abstract of Japan; vol. 9, No. 142; Jun. 18, 1985; & JP 60 022092 A; Feb. 4, 1985.

* cited by examiner

*Primary Examiner*—Thomas Denion
*Assistant Examiner*—Theresa Trieu
(74) *Attorney, Agent, or Firm*—Nixon & Vanderhye P.C.

(57) ABSTRACT

A rotary pump for pumping compressible fluid comprising an eccentrically mounted rotor 20 and a stator 10. The stator 10 comprises a stator inner liner 80 that is free to rotate, driven directly or in response to rotation of the rotor 20 such that the relative velocity between the outer surface of the rotor 20 and the inner surface of the stator 10 is reduced. The vanes 40 are held at each end by sockets 90, 95 in the rotor 20 and stator 10. The vane 40 and socket 90, 95 coupling provides fluid sealing without liquid lubricant. Opposing solid lubricant and hard surfaces are used on contact surfaces between the elements.

19 Claims, 4 Drawing Sheets

ROTARY PUMP

This application is the U.S. national phase of international application PCT/GB00/02150 filed Jun. 2, 2000, which designated the U.S.

BACKGROUND OF THE INVENTION

1. Field of the Invention

This invention relates to rotary pumps.

2. Discussion of Prior Art

Rotary pumps are known devices that are used in a wide range of applications to pump fluids from one place to another and to compress them. A known rot is shown in FIG. 1 of the accompanying drawings. This pump comprises a stator 10 and a rotor 20, the rotor being eccentrically mounted within the stator. The rotor comprises a main body 30 with vanes 40 extending from the main body. The vanes are slideably mounted on the rotor main body such that they can be pushed back into the main body against an outward bias. When the rotor is eccentrically mounted within the stator as shown in FIG. 1, the vanes extend out from the rotor and contact the inner surface of the stator. Due to the eccentric mounting of the rotor the radial extension of each vane varies with angular displacement around the rotor main body.

In operation, rotation of the rotor causes the vanes to sweep along the inner surface of the stator and be pushed back into the rotor main body for the part of the revolution where the rotor main body approaches closer to the stator. The vanes outer rotor surface and stator surface define cavities within the pump. The fluid, for example air, to be pumped enters the pump at the fluid inlet 50. The fluid inlet is located at a point where the rotor is far from the stator, the vanes are extended and the cavity into which the fluid flows is relatively large. As the rotor rotates the vanes defining the input cavity are pushed into the main rotor body and thus the size of the cavity decreases and the fluid is compressed. The fluid outlet 60 is located at a position where the rotor is close to the stator and the vanes are close to or at their minimum extension, thus the cavity is reduced in size and compressed fluid flows out of the fluid outlet An inlet is provided for adding a lubricating fluid such as oil.

In order to prevent fluid leaking from one cavity of the pump to the next the rotor vanes and stator inner liner must provide a seal. This means that the contact between the stator inner liner and rotor vanes must be good and therefore friction between these surfaces tends to be high. A high friction contact between the surfaces results in the rotor being difficult to turn and to wear of the contact surfaces. One way of addressing this problem is to provide lubrication of the surfaces. This can be done by injecting large quantities of a liquid lubricant such soil into the pump. A disadvantage of this approach is that the oil mixes with the fluid as it is compressed by the pump, with several undesirable consequences. The fluid and oil mixture must be separated downstream of the rotary pump, which is an expensive process, the pump must be continually re-lubricated, and pumping the oil in addition to the fluid results in a loss of efficiency.

Oil-free pumps have been provided by coating the moving parts of the pump with a solid lubricant. However, this coating wears away rapidly, producing debris and the need for frequent servicing and replacement.

Page 40 of "Pneumatic Handbook", by A. Barber 7th edition, discloses a vaned compressor which has a plurality of floating or restraining rings placed over each vane. The rings rotate with the vanes and maintain a minimum clearance between the vane tips and the casing wall. The rings rotate at a constant speed, whereas the vanes speed varies with extension, so there is some relative "rolling motion" between vanes and rings. A similar arrangement is disclosed in "L'air comprime, by J. Lefevre, editeurs Paris, pages 317–318". An orbital vane compressor is produced by Dynew Corporation which comprises a bearing mounted within the stator which allows the blades to extend only to a desired amount thereby keeping a clearance with the stator wall.

A further type of compressor is that produced by Robert Groll in co-operation with the company Rotary Compression Systems. This pump has sockets housing sliding vanes U.S. Pat. No. 2029554 and GB-A-363471 disclose rotary pumps having vanes mounted in pivotable sockets in both the rotor and the rotatable stator inner lining of the pump.

DE-A-4,331,964 discloses a vacuum pump with ball bearings mounted between the stator inner lining and main body.

SUMMARY OF THE INVENTION

WO-A-97/21033 discloses a rotary compressor with reduced lubrication sensitivity. In order to combat problems that may occur with liquid lubricants, additional lubrication is provided by adding a "DLC" coating to a vane in the compressor. This coating is formed of layer of hard and lubricious substances.

Further examples of other known rotary pumps are shown in British Patents GB-A-2,322,913, GB-A-2,140,089, GB-A-2,140,088, GB-A-809,220, GB-A-728,269, GB-A-646,407, GB-A-501,693 and U.S. Pat. No. 4,648,819.

In accordance with the present invention there is provided a rotary pump comprising: a fluid inlet and a fluid outlet; a stator comprising a main body and an inner liner rotatably mounted within the main body; a rotor comprising a main body eccentrically mounted within the stator; vanes extending from the rotor towards an inner surface of the stator inner liner, the stator inner liner, vanes and outer rotor surface defining pump cavities; wherein the stator inner liner is operable to rotate when the rotor rotates, such that the relative velocity between the vanes and the inner surface of the stator is reduced; the vanes are each mounted such that they are received by and extend between a rotor fixing and a stator inner liner fixing, the motor fixings and stator inner liner fixings being mounted within the rotor and stator inner liner respectively such that the angle of the vanes to the rotor can vary with rotation of the rotor; the rotor fixings and the stator inner liner fixings provide fluid sealing between said pump cavities for normal operation without liquid lubricant, and wherein said vanes and at least one of said rotor sockets and said stator inner liner sockets contact one another at respective contact surfaces, a first of said contact surfaces being a solid lubricant surface and a second of said contact surface being a hard surface so as to provide reduced friction fluid sealing contact without liquid lubricant.

The device of the present invention alleviates the disadvantages of the prior art by providing a stator inner liner that rotates together wit the rotor, thereby reducing the relative velocity between the rotor and stator. This leads to lower sliding speeds and milder contact conditions between the rotor and stator. Thus, the rate of wear of the contact surfaces is reduced. Furthermore, this reduced motion allows the vanes to be held within fixings (such as sockets or bonded bushings) in a manner that allows fluid sealing between cavities without the need for liquid lubricants.

Mounting of the vanes in sockets, results in an improved fluid seal between neighboring pump cavities which gives reduced leakage of pumped fluid between pump cavities. Furthermore, the mounting of the vanes in sockets such that the angle of the vanes to the rotor can vary means that there is no oscillating motion between contact surfaces of the vane tips and stator inner liner with the associated problems of frictional losses and wear of the two surfaces.

Advantageously, the rotor sockets and the stator inner liner socket are rotatable about an axis aligned with their geometric centres and parallel with the axis of rotation of the rotor. In preferred embodiments, the angle of the vanes oscillates about a central position with rotation of the rotor, the central position being preferably with the vanes extending radially outwardly from the rotor.

This is a convenient arrangement that enables the vane angle to change while the rotor rotates while providing a good seal between neighboring pump cavities and reduced frictional wear.

In some embodiments, the vanes are slideably mounted within the rotor socket and are fixedly mounted within the stator inner liner socket.

Although the vanes can be slideably mounted within the socket of the stator inner liner it is preferable that they are slideably mounted within the rotor, as the size of this rotor socket is not restricted by the width of the stator inner liner which is generally quite thin. In order to ensure that the vanes extend to the stator inner liner socket and provide a good fluid seal between cavities, they are fixedly mounted within the stator inner liner.

Preferably, the solid lubricant surface may be PTFE and the hard surface may be one of steel coated with diamond like coatings, tungsten carbide, graphite and molybdenum disulphide.

The rotor, stator inner liner and vanes may be hard coated steel and the sockets may be solid lubricant in the form of PTFE, pure or reinforced with coated glass, bronze, molybdenum disulphide or graphite.

Ball bearings may be mounted between stator and stator inner liner. In this way, the stator inner liner is held in position away from the stator and frictional forces inhibiting rotation are reduced.

Embodiments of the present inventions will now be described, by way of example only, with reference to the accompanying drawings, in which:

DETAILED DISCUSSION OF EMBODIMENTS

Figure 1:
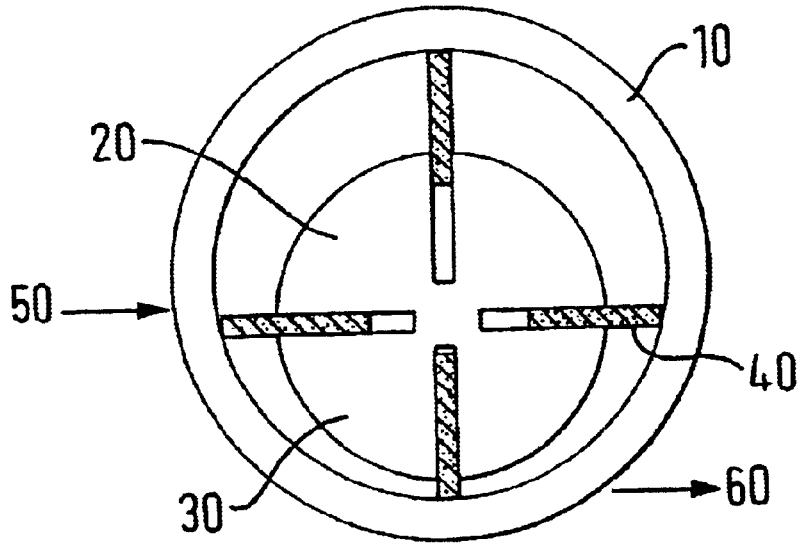
FIG. 1 (Prior Art)
FIG. 1 illustrates a known rotary pump.
Figure 2:
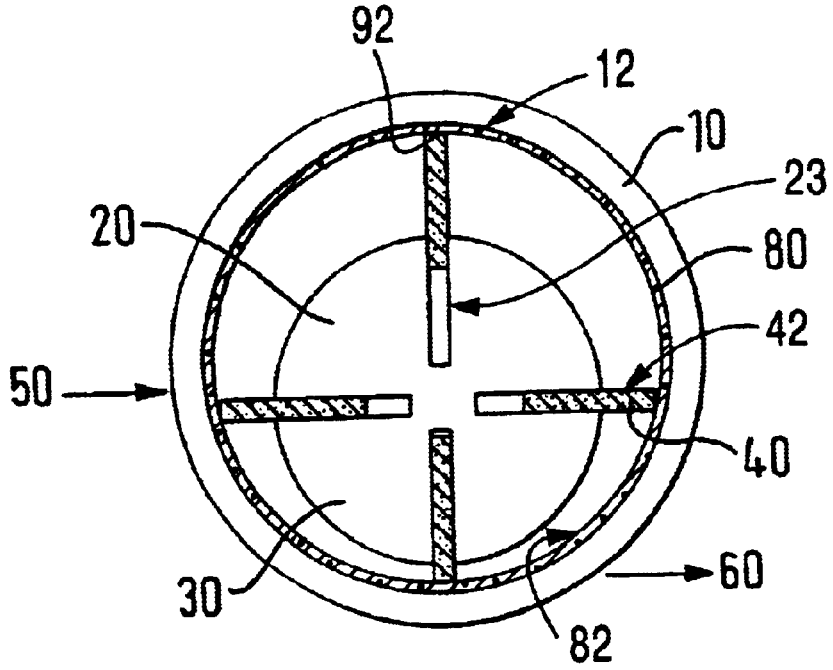
FIG. 2 illustrates a rotary pump having a rotating stator inner liner.

With reference to FIG. 2, a rotary pump illustrates the principle or the rotating stator inner liner is illustrated. This pump comprises a stator 10, a rotor 20 with rotor main body 30 and vanes 40, a fluid inlet 50 and outlet 60 and a stator inner liner 80 is shown. The pump differs from the pump shown in FIG. 1 in that it additionally comprises a stator inner liner 80. The stator inner liner 80 is mounted within the main stator body 10 and is free to rotate. The vanes 40 of the rotor 20 contact the stator inner liner 80 rather than the stator main body 10.

Figure 5:
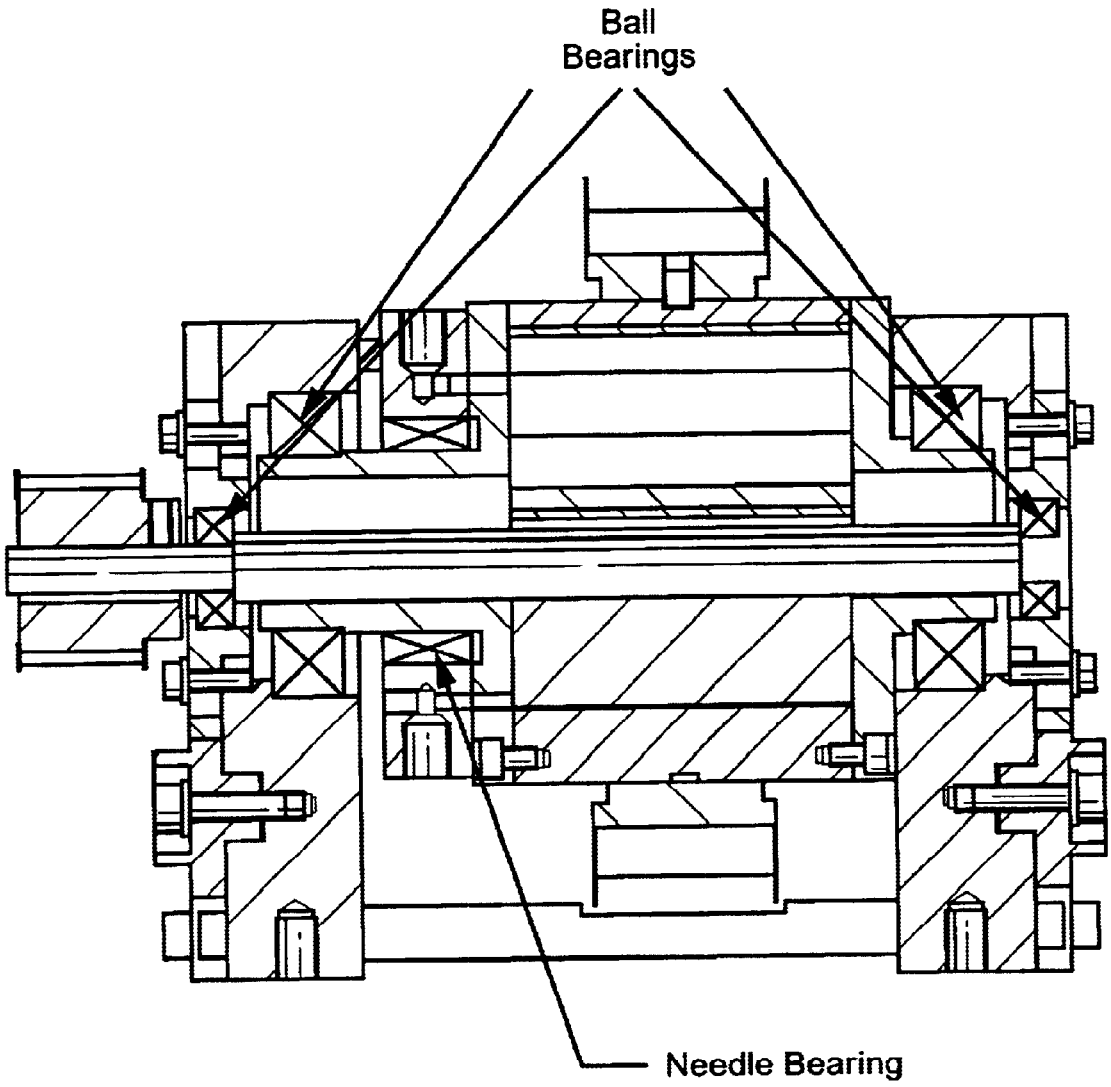
FIG. 5 illustrates bearings between the stator and stator inner lining.

As the rotor turns the vanes 40 sweep along the surface of the stator inner liner 80. The vanes 40 exert a rotational torque on the stator inner liner 80, which is mounted such that it is free to rotate, and this causes it to rotate. The dimensions of the stator inner liner 80 are such that there is a gap between the stator main body 10 and the stator inner liner 80. A bearing can be provided between the stator main body 10 and the stator inner liner 80 by ball bearings 82 (in FIG. 5) mounted between the stator main body 10 and stator inner liner 80. In some embodiments, the force of the vanes 40 on the stator inner liner 80, is used to cause it to rotate. In other embodiments the stator inner liner 80 is driven by the rotor shaft, possibly using bellows directly attached to the rotor shaft. The resulting relative velocity between the vanes 40 of the rotor 20 and stator inner liner 80 is thus much lower than would be the case for a static stator inner liner.

It should be noted that due to the eccentric mounting of the rotor main body 30, the velocity of the rotor vanes 40 varies with their radius around the circumference. The stator inner liner 80 rotates about its centre point and as such does not have a velocity that varies with angular position. Thus there is a small oscillating motion of the vane tips on the rotating stator inner liner 80. The contact surfaces 2, 82 of the rotor 20 and stator inner liner 80 are, preferably, coated with solid lubricants to reduce frictional forces arising due to this oscillating motion. In some embodiments, contact surface 82 of the stator inner liner 80 is coated with a solid lubricant coating in the form of a PTFE composite (polytetrafluoroethylene) as is the inner surface 12 of the stator main body 10. The rotor vanes 40 have a hard tungsten carbide coating, preferably bound to a steel substrate. Alternatively, the hard tungsten carbide coating 42 may be bound to a multilayered structure consisting of titanium nitride/carbide or a diamond (diamond-like), graphite or molybdenum disulphide/coating.

In operation, compressible fluid enters a chamber of the pump at fluid inlet 50. As the rotor rotates, this chamber moves out of fluid connection with fluid inlet 50 and a subsequent chamber connects with the fluid inlet 50. Due to the eccentric mounting of the rotor main body 30 and the position of the fluid inlet 50. as the rotor main body 30 rotates away from the fluid inlet 50 its outer circumference becomes closer to the stator inner liner 80 and the slideably mounted vanes 40 which are biased to extend from the rotor main body 30 are pushed back into the rotor main body 30. This decreases the size of the chamber containing the fluid and it is compressed. The chamber moves on to connect with the fluid outlet 60 and the compressed fluid exits the pump through this outlet. The rotor main body 30 is close to the stator 10 at the fluid outlet 60 so that the chamber is small at this position and fluid is pushed from the pump.

Figure 3:
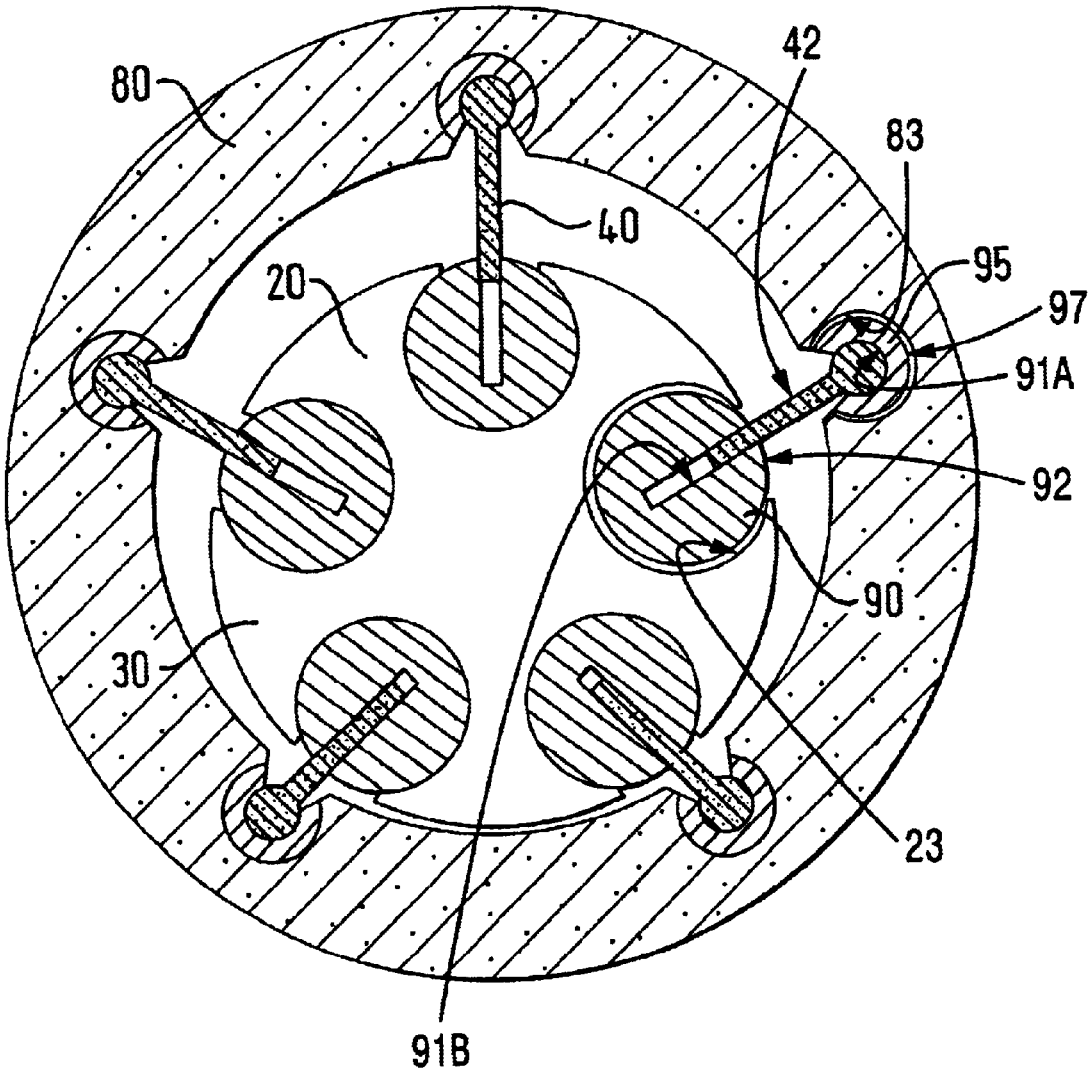
FIG. 3 illustrates a rotary pump having rotor and stator socket.

FIG. 3 illustrates an embodiment of the invention in which like parts to FIGS. 1 and 2 bear the same numerical designations (and shaped areas correspond to reinforced PTFE). This embodiment differs from the embodiment of FIG. 2 in that the vanes 40 are slideably mounted within rotor rotatable sockets 90 in the rotor main body 30 and extend to stator rotatable sockets 95 within the stator inner liner 80 in which they are fixedly mounted. On rotation of the rotor 20 and stator inner liner 80, the variation of the velocity of the outer tips of the rotor vanes 40 arising due to the eccentric mounting of the rotor main body 30 causes the sockets 90, 95 to oscillate about their central position and the angle of the vanes 40 to oscillate about a central perpendicular position. This is illustrated in FIG. 3, wherein the angle of the vanes 40 varies to compensate for the variation in velocity of the outer vane tips with rotation. Thus, in this embodiment the mounting of the vanes 40 in sockets 90, 95 with resulting change in angle of the rotor vanes 40 means that there is no oscillating motion between contact surfaces of the vane tips and stator inner liner 80 with associated problems of wear of the two surfaces. In this arrangement the contact areas within the rotating sockets are over a larger area than with the blade tip on the inner stator liner 80, and thus the forces exerted and wear rates are correspondingly reduced. Furthermore, this arrangement leads to a better seal between neighboring pump cavities with reduced leakage of pumped fluid and without the need for liquid lubricant.

The vanes 40 are generally fixedly mounted within the stator inner liner socket 95 and free to slide in the rotor socket 90 without any bias. This may be done by brazing a rod onto the rotor blade tip and mounting this within the stator socket 95 or by machining the vane 40 and its cylindrical head from a solid piece. Alternatively, the vanes 40 may be slideably mounted within the rotor socket 90 with an outward bias, such that they extend into the stator inner liner socket 95 at all times. The respective contact surfaces 92, 97 of the rotor and stator sockets 90, 95 and respective contact surfaces 23, 83 of the rotor and stator receiving cavities within the rotor and stator inner liner may be coated with solid lubricants (such as PTFE against tungsten carbide) to reduce frictional forces and wear of the surfaces, as may the respective contact surfaces 42, 91*a*, 91*b* of the rotor vanes 40 and rotor socket 90. FIG. 3 gives the dimensions of a preferred embodiment of the pump.

Figure 4:
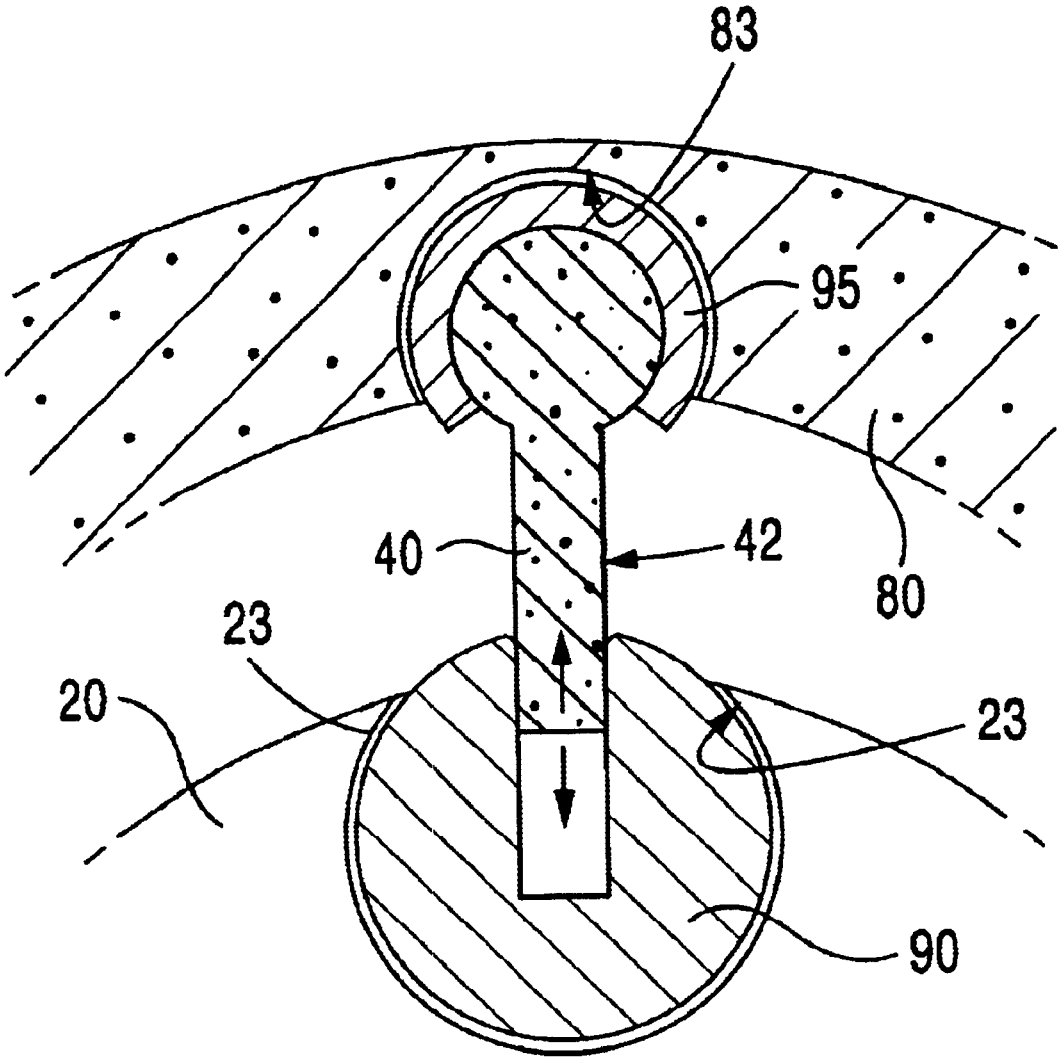
FIG. 4 illustrates the rotor and stator sockets of another embodiment in more detail.

FIG. 4 illustrates another embodiment. In this embodiment there is a cylinder at the outer end of the vane 40 that is held within the stator socket 95. The vane 40 slides within a slot within the rotor socket 90 as the rotor rotates.

The vane 40 contact surface 42 is steel coated in one of a diamond like coating, tungsten carbide, graphite or molybdenum disulphide. The rotor 20 and the stator inner liner 80 are steel with at least the portions of the rotor receiving cavity contact surface 23 contacting the rotor socket 90 and the stator receiving cavity contact surface 83 contacting the stator inner liner socket 95 being coated in the same way as the vane 40. The rotor socket 90 and the stator inner liner socket 95 are one of PTFE, pure or reinforced with glass, bronze, molybdenum disulphide or graphite. This arrangement provides opposing solid lubricant and hard surfaces throughout.

As an alternative to the sockets 90, 95 providing the fixings at each end of the vanes, 40, one or both of these may be replaced with a bonded bushing 92 (in FIG. 2) containing a high temperature resistant elastomeric material such as nitrile synthetic rubber. This removes the need for dry lubricant materials at this location, but not at the sliding seal, the vane sides or the output valve.

What is claimed is:

1. A rotary pump comprising:

a fluid inlet and a fluid outlet;

a stator comprising a main body and an inner liner rotatably mounted within the main body;

a rotor comprising a main body eccentrically mounted within the stator;

vanes extending from the rotor towards an inner surface of the stator inner liner, the stator inner liner, vanes and outer rotor surface defining pump cavities; wherein the stator inner liner is operable to rotate when the rotor rotates, such that the relative velocity between the vanes and the inner surface of the stator is reduced;

the vanes are each mounted such that they are received by and extend between a rotor fixing and a stator inner liner fixing, the rotor fixings and stator inner liner fixings being mounted within the rotor and stator inner liner respectively such that the angle of the vanes to the rotor can vary with rotation of the rotor;

the rotor fixings and the stator inner liner fixings provide fluid sealing between said pump cavities for normal operation without liquid lubricant; and wherein each of said vanes and at least one of said corresponding rotors and said corresponding stator inner liners having respective contact surfaces, a first of said contact surfaces being a solid lubricant surface and a second of said contact surface being a hard surface so as to provide reduced friction fluid sealing contact without liquid lubricant.

2. A rotary pump according to claim 1, wherein the vanes are each mounted such that they are received by and extend between at least one of a rotor socket and a stator inner liner socket.

3. A rotary pump according to claim 2, wherein said hard surface is coated with one of a diamond like coating or a tungsten carbide, graphite or molybdenum disulphide coating.

4. A rotary pump according to claim 2, wherein at least one of said rotor sockets and said stator inner liner sockets includes one of pure PTFE and PTFE reinforced with one of glass, bronze, molybdenum disulphide and graphite.

5. A rotary pump according to claim 2, wherein at least one of said rotor sockets and said stator inner liner and a respective one of said rotor and said stator inner liner contact one another at respective contact surfaces, one of said contact surfaces being a solid lubricant surface and another of said contact surfaces being a hard surface so as to provide reduced friction fluid sealing contact without liquid lubricant.

6. A rotary pump according to claim 5, wherein said solid lubricant surface is PTFE based.

7. A rotary pump according to claim 6, wherein at least one of said rotor sockets and said stator inner liner sockets includes a portion of PTFE reinforced with one of glass, bronze, molybdenum disulphide and graphite.

8. A rotary pump according to claim 5, wherein said hard surface is one of a diamond like coating or a tungsten carbide, graphite or molybdenum disulphide coating.

9. A rotary pump according to claim 8, wherein at least one of said rotor and said stator inner liner is formed of steel coated with one of a diamond like coating, a tungsten carbide coating, a graphite coating and a molybdenum disulphide coating.

10. A rotary pump according to claim 2, wherein the rotor sockets and the stator inner liner sockets are rotatable about an axis aligned with their geometric centre and parallel with the axis of rotation of the rotor.

11. A rotary pump according to claim 10, wherein the angle of the vanes oscillates about a central position with rotation of the rotor.

12. A rotary pump according to claim 11, wherein the central position is with the vanes extending radially outwardly from the rotor.

13. A rotary pump according to claim 10, wherein the vanes are slideably mounted within the rotor socket and are fixedly mounted within the stator inner liner socket.

14. A rotary pump according to claim 1, wherein said solid lubricant surface is PTFE based.

15. A rotary pump according to claim 1, wherein said vanes are formed of steel coated with one of a diamond like coating, a tungsten carbide coating, a graphite coating and a molybdenum disulphide coating.

16. A rotary pump according to claim 1, wherein an outer radius of the stator inner liner is smaller than an inner radius of the main stator body.

17. A rotary pump according to claim 13, further comprising ball bearings rotably mounted between the stator inner liner and stator main body.

18. A rotary pump according to claim 1, wherein the rotor main body, stator and stator inner liner all have circular cross sections.

19. A rotary pump according to claim 1, wherein at least one end of each vane is fixed by a bonded bushing.

* * * * *